United States Patent [19]

Compton et al.

[11] 4,041,306

[45] Aug. 9, 1977

[54] LUMINAIRE AND REFLECTOR THEREFOR

[75] Inventors: Wayne W. Compton, Irvine; Robert Paul Draper, Sunland, both of Calif.

[73] Assignee: Kim Lighting, Inc., City of Industry, Calif.

[21] Appl. No.: 640,466

[22] Filed: Dec. 15, 1975

[51] Int. Cl.[2] ..... F21V 7/09

[52] U.S. Cl. ..... 240/103 R; 240/25

[58] Field of Search ..... 240/73 BC, 78 LK, 41.35 E, 240/41.35 R, 103 R, 106, 106.1, 51.11 R, 25, 147

[56] References Cited

U.S. PATENT DOCUMENTS

| | | | |
|---|---|---|---|
| 2,143,673 | 1/1939 | Baumgartner | 240/103 R X |
| 2,414,657 | 1/1947 | Mitchell | 240/103 R |
| 2,778,929 | 1/1957 | Loehr | 240/25 |
| 3,179,793 | 4/1965 | Franck | 240/25 |
| 3,189,739 | 6/1965 | McPhail | 240/25 |
| 3,350,556 | 10/1967 | Franck et al. | 240/25 |
| 3,679,893 | 7/1972 | Shemitz et al. | 240/103 R |
| 3,701,896 | 10/1972 | Pate | 240/103 R X |
| 3,746,854 | 7/1973 | Brass | 240/25 X |
| 3,786,248 | 1/1974 | Compton | 240/25 |
| 3,836,767 | 9/1974 | Lasker | 240/25 |

*Primary Examiner*—Donald A. Griffin
*Attorney, Agent, or Firm*—Donald D. Mon

[57] ABSTRACT

A luminaire which casts a substantially rectangular pattern of light on a surface. It utilizes a lamp which has an axis of radiation and the property of emitting a disproportionately larger percentage of its luminous flux in an annulus which lies between a substantial bounding region at each end of the lamp. A reflector includes a cavity in which the lamp is placed. The reflector has a cutoff edge that forms an aperture opening from the cavity. Support means mounts the lamp in the cavity above the cutoff edge. Specular reflecting means is provided in the reflector to reflect light which is initially directed above the cutoff edge to the surface as supplementary light to fill in areas where light that is directly emitted through the aperture without reflection does not provide proper illumination to the surface.

32 Claims, 15 Drawing Figures

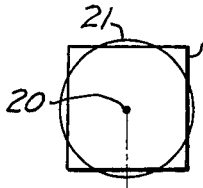
FIG. 1
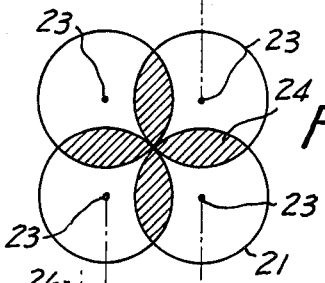
FIG. 2
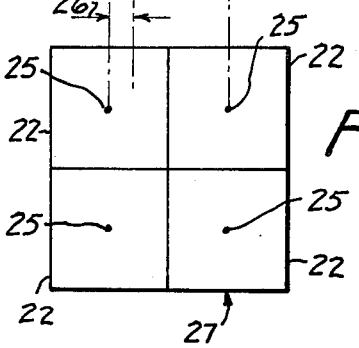
FIG. 3
FIG. 6
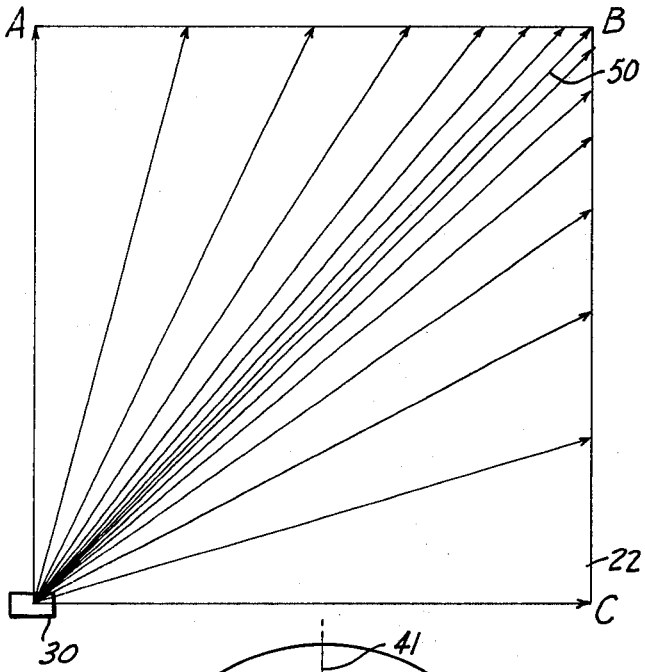
FIG. 3A
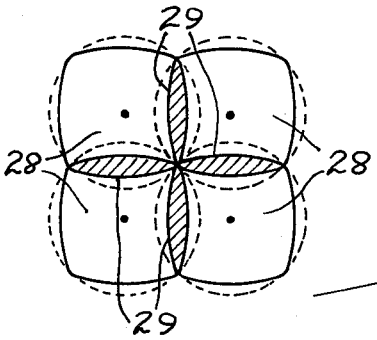
FIG. 5
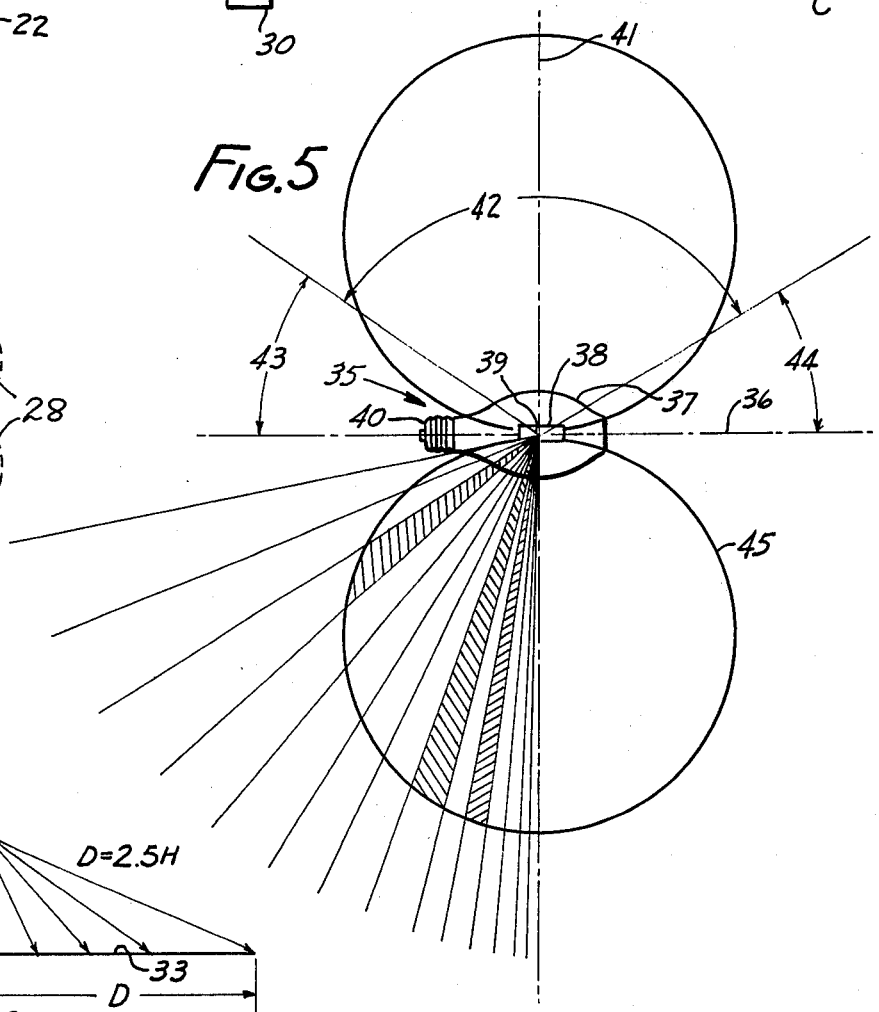
FIG. 4
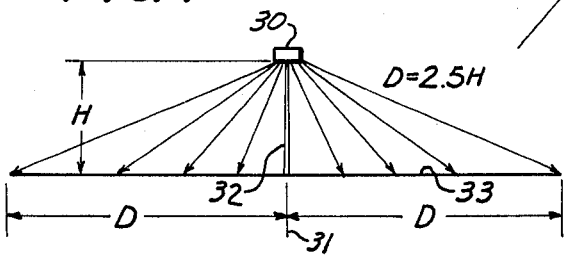

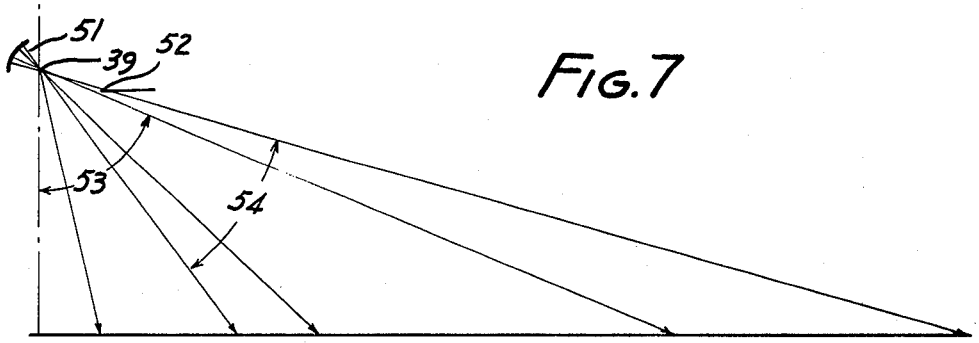
FIG. 7
FIG. 12
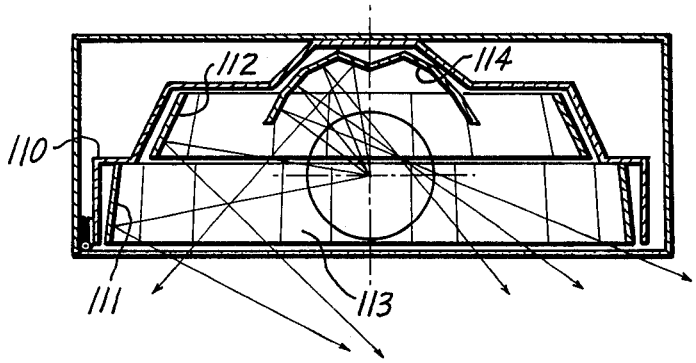
FIG. 13
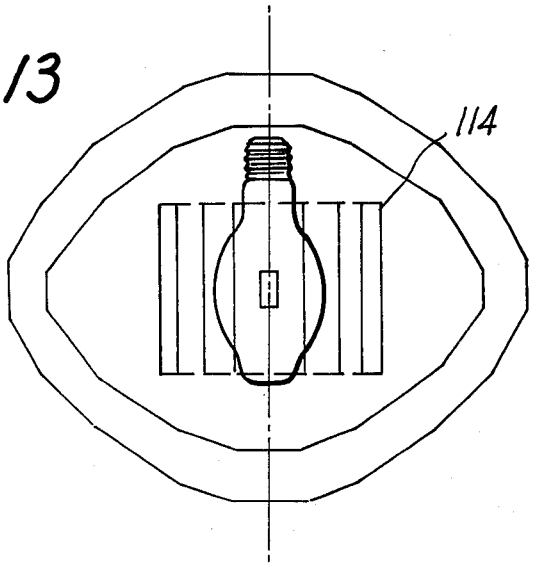

LUMINAIRE AND REFLECTOR THEREFOR

This invention relates to luminaires for area lighting, and especially to a luminaire which provides a rectangular pattern of illumination. This invention also relates to reflectors for usuage in luminaires of this type.

This invention relates primarily to the class of luminaires known in the lighting industry as "cutoff" type fixtures. Such luminaires are useful for outdoor illumination. They can also be utilized for indoor areas.

Cutoff luminaires have properties which are becoming increasingly appreciated, because they solve many lighting problems that are objected to by architects, engineers, and environmentalists. A cutoff luminaire is one which reduces glare in the sky by precisely controlling the high angle light which is a prime source of glare from conventional luminaires. By significantly reducing the intensity of light at high vertical angles, say 75° and above, and completely eliminating all light at 90° and above, this invention increases night time visibility, because the background contrast is not reduced by scattered light. This in turn reduces the amount of light and energy which is required to illuminate a given area. In addition, a good cutoff luminaire drastically reduces the size of the light source which is directly seen by an observer at a distance from the luminaire. The nighttime view and landscape are thereby greatly improved.

To produce a good cutoff type luminaire, it has been found that there are three principal requirements:

a. a reflector of highly specular finish and precise design which distributes the light broadly and evenly in a predetermined pattern;

b. a light source of minimum size to maximize the effectiveness of the reflector while keeping the size of the reflector itself as small as possible;

c. a clear, light-emitting window which preferably remains horizontal and faces the ground.

The prior art is replete with the use of prismatic lenses to control the distribution of light from a luminaire. Such lenses are commonly found in street lights. They produce unwanted glare because of the inherent geometry of the prismatic lens, and because the glass itself scatters considerable light. Such a luminaire becomes a "hot spot" of illumination in the sky. Conventional luminaires do produce a useful pattern with the usage of a reflector and a lens, but when they do, the prismatic lens also produces objectionable side effects. It is a feature of this invention that at the exit from the reflector, there is either an open cavity or merely a clear window without prismatic effect. There is no prismatic lens at all.

The majority of cutoff type luminaires which are available on the market today are of the asymmetrical light distribution type. Such types are commonly described in the lighting industry as ANSI or IES types II, III, or IV. One such type which utilizes only a reflector and which does not use a prismatic lens is shown in Compton U.S. Pat. No. 3,786,248, issued Jan. 15, 1974. These luminaires are designed for street lighting and also for area lighting, such as for parking lots. They are well-suited for street lighting because of their asymmetrical light pattern. In order to provide lighting for large areas, conventional and Compton type luminaires usually are grouped in twin or quadruple assembly where their light patterns overlap and waste light and energy at the overlapped areas. In fact, comparisons of the present invention with luminaires which cast asymmetrical or circular patterns show that a substantially greater pole spacing can be achieved with the rectangular light pattern according to this invention, because light overlap is minimized, that there will be a very substantial increase in area illuminated by multiple-pole installations of identical numbers of luminaires, and that this improvement in efficiency and economy increases as the number of poles increases. As a consequence, substantially rectangular light pattern csn become more efficient as the project size increases. There is a very substantial gain in the number of square feet of area illuminated per pole.

It is also evident that the cost of lighting an area such as a parking lot with twin or quadruple units is much greater than if the same useful light pattern could be amitted from a single fixture. The luminaire of this invention produces a rectangular light pattern from a single luminaire that can be mounted atop a central pole. This arrangement is ideal for general area lighting such as for parking lots, plazas and parks. A rectangular light pattern of this type is similar to the type which is produced by four typical asymmetrical luminaires mounted in a quadruple arrangement at 90° intervals to each other. However, there is a substantial difference, because there are only minimal areas of overlap which waste energy. What is also important is that this improved result is accomplished with the use of only one luminaire instead of with four. The economic advantages are self-evident.

If such intense light levels are desired that they cannot be accomplished with one fixture by increasing the lamp intensities, then additional luminaires can be added to a pole, such as with a twin or quadruple arrangement. However, the requirements of the great majority of lighting installations can be fulfilled with one fixture per pole, using higher wattage lamps when higher illumination levels are desired. With presently-existing asymmetrical fixtures, one is forced to use higher levels of illumination from the twin or quadruple fixtures for the sake of achieving a desired light pattern, regardless of the intensity.

It is a significant advantage of this invention that it can produce a substantially rectangular light pattern from a single reflector and a single lamp. The economics are important when put into application for area lighting. One of the primary objectives of any lighting installation is to provide broad illumination with maximum pole spacings. Pole spacings, however, are quite often limited by uniformity limits set up by I. E. S. standards. Uniformity is the ratio of average illumination on a given area to the minimum illumination value in that area. For example, the accepted standard for parking lots is 4:1 which means that if one desires to have an average illumination of 2 foot candles, the minimum at any point within the illuminated area can be no less than 0.5 candles. To accomplish this uniformity with the greatest pole spacings and with the least amount of wasted light, a substantially rectangular-substantially square, pattern is the most economical, and a round pattern is the worst. Most present day area luminaires utilize circular, or at least asymmetrical and markedly curved light patterns. This invention therefore provides significant advantages over existing art.

It is evident that this luminaire has economical advantages not only for outdoor usage, but also for the indoor lighting of factories, stores, classrooms, or any interior space where general illumination is desired with a minimum number of luminaires and with the most efficient utilization of energy. Indoor applications will frequently require sharper cutoff boundaries than outdoor applications, and this invention can provide them.

The objectives of this invention are accomplished by utilizing a reflector which casts a substantially rectangular pattern of light on a surface from a lamp of the class which has an axis of radiation and the property of emitting a disproportionately larger percentage of the luminous flux in an annulus which lies between a substantial bounding region at each end of the lamp, in which regions the emission is disproportionately low. The reflector has a nominal axis of emission, a concave cavity in which the lamp is supported, a cutoff edge which forms an aperture opening from the cavity and which lies in a plane normal to the nominal axis, and support means to mount the lamp in the cavity.

The reflector also includes in the cavity specular reflecting means which reflect supplementary light. The supplementary light comprises at least some of the light which is emitted from the lamp in the angular subtense above the limiting rays from the lamp which graze the cutoff edge. The supplementary light is distributed in a pattern which is supplementary to the pattern laid down by the direct rays which pass directly from the lamp through the aperture to the surface without reflection. The combined patterns form rectangular pattern with a predetermined (but not uniform) luminar intensity on the surface. The intensity usually decreases as a function of the distance from the intersection of the nominal axis with the surface.

According to a preferred but optional feature of the invention, the reflector is a physically continuous structure.

According to still another preferred but optional feature of the invention, the reflecting means comprises a plurality of separate reflecting strips.

The above and other features of this invention will be fully understood from the following detailed description and the accompanying drawings, in which:

FIGS. 1, 2 and 3 are schematic plan views comparing how circular and square patterns are combinable to encompass a given area;

FIG. 3*a* is a schematic view showing more precisely how an area is illuminated by a practical luminaire according to this invention;

FIG. 4 is a schematic elevation showing the illumination of an area by the luminaire of the invention;

FIG. 5 is a schematic view showing the distribution of luminous flux from a lamp of the type used in this luminaire;

FIG. 6 shows one of four quadrants of the area illuminable by the luminaire of this invention;

FIG. 7 shows certain features of illumination in elevation;

FIG. 12 is a fragmentary axial cross-section of another embodiment of the invention;

FIG. 13 is a bottom view of FIG. 12; and

Figure 8:
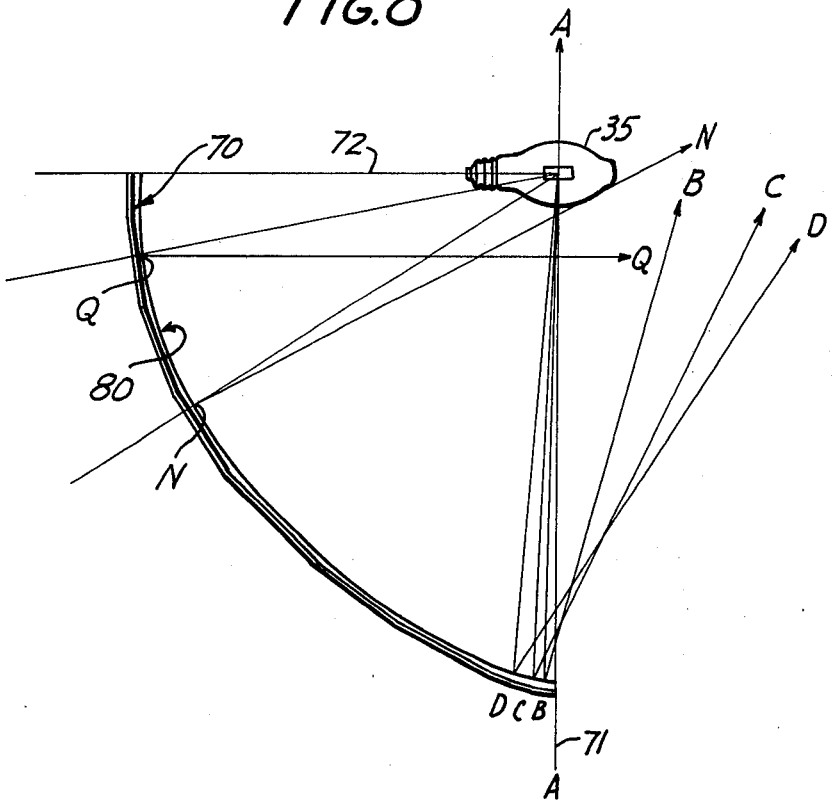
FIG. 8 is a plan view showing certain design criteria for the reflecting means.

Some of the advantages of the instant invention are theoretically illustrated in FIGS. 1, 2 and 3, wherein the pole spacings and effective areas of illumination of two different theoretical light patterns are shown. In FIG. 1 there are shown around a central pole 20 a circular pattern 21 produced by prior art reflectors, and a rectangular pattern 22 which is an idealization of a substantially rectangular pattern produced by the instant invention. In order to secure full illumination of the circular areas between the four poles 23 in FIG. 2, there need to be the overlapping leaflet-shaped areas 24. These constitute a waste of radiant energy and can be hot spots of illumination. This is, however, the most effective use of multiple circular patterns.

In contrast, square patterns 22 can be abutted as shown in FIG. 3, with poles 25 spaced apart as shown to provide full area illumination without substantial overlap of adjacent patterns. There is an increased spacing 26 between the poles. For systems where a circular and square pattern have the same maximum throw, fewer poles would need to be utilized to cover a given area with a square or rectangular pattern as shown than with circular patterns. A more effective distribution of light can be had without requiring any substantial areas to be overlapped.

Actually, a true rectangle with straight edges and sharp corners is not the preferred pattern. Instead, a substantially rectangular pattern 28 such as shown in FIG. 3*a* is generally better. The edges are slightly bent and convex, and the corners are radiused. This provides for some slack in "fit" or abutment of the patterns. As with the overlap of circular patterns, there will be some petal-shaped areas 29 of overlap, but these can be made considerably smaller than the overlaps inherent in the usage of circular patterns. The term "rectangular" includes "square", and the term "substantially rectangular" means a somewhat obtuse and rounded shape as shown in FIG. 3*a*, as well as nearer approaches to the idealized strictly rectangular pattern, and also the strictly rectangular pattern itself.

Incidentally, it is not an objective of this invention to provide illuminated areas in which the intensity is uniform over the entire surface. Surprisingly, an absolutely uniform illumination of large areas can present to the eye an undesirable undulating and rough surface appearance. Instead, it is usual for the illumination to "fall off" from the center pole to an edge 27 by a permissible ratio. 4:1 is a commonly used ratio, although ratios as high as 15:1 are permissible in some applications. This ratio compares the intensity at the pole and at the farthest corner of the pattern. An area such as FIG. 3 lighted as shown with the dim areas adjoining at edge 27 will appear normal to the eye and will have at all places at least the minimum illumination required by the specifications.

FIG. 4 shows one suitable relationship relative to a luminaire 30 having a nominal axis 31 which is generally vertical and atop a pole 32. The surface 33 is illuminated to a distance D which reaches to the side of a square, and the luminaire is at a distance H above the surface. A common ratio is for 2D to be about five times the height. The distance to the corner would be about 3½ times the height in a theoretically ideal arrangement where the edges are straight and the corners are sharp. However, because the corners are often rounded, this ratio is not especially precise.

Reflectors of the type utilized in the luminaire of this invention are intended to direct the light from commercial lamps. They may conveniently be made in large and small reflector size, and these may readily be scaled to accommodate lamps of the following size and capacity:

| | Mercury Vapor | Metallic Halide | High Pressure Sodium |
|---|---|---|---|
| SMALL REFLECTOR: | 100 Watt | 175 Watt | 70 Watt |
| | 175 Watt | 250 Watt | 100 Watt |
| | 250 Watt | 400 Watt | 150 Watt |
| | 400 Watt | | 250 Watt |
| | | | 400 Watt |
| LARGE REFLECTOR: | 1000 Watt | 1000 Watt | 1000 Watt |

These lamps are presently manufactured, and are shown by way of examples of useful lamps, rather than of limitation. Different lamps having features which are of significance to this invention, can be used instead.

Lamps of the type useful in this invention have a distinctive pattern of distribution of their luminous flux which is generally known to the trade. This distribution pattern is important in developing the shape of the reflecting means which are used in this invention. An understanding of the invention requires a knowledge of this pattern. In FIG. 5 there is shown a lamp 35 having an axis of radiation 36. The lamp includes a glass envelope 37 with emitting means 38 inside it. The emitting means is usually of substantial length. For convenience in this invention, the emitting means will be treated as though it emitted all of its lights from a point 39 at the middle of the emitting means. This is, of course, an approximation. However, as a practical matter, although the surfaces are designed by the use of the theoretical concept disclosed below, the actually-constructed surfaces will not be exact in their locations and curvatures because of the manufacturing processes (usually deep drawing) used to build a practical device. Also, it is good practice to build one reflector which can utilize various different lamps. The approximation of design based upon a point source is this well within the desired accuracy. Furthermore, reasonable divergences from the theoretical are potentially useful, because their tendency generally is to round or soften the corners of the pattern.

The lamp conventionally includes a stem 40 which is threaded into a socket by means of which electrical energy is supplied to the lamp to generate light. A reference plane 41 passes through point 39 and is normal to axis 36.

Luminous flux is emitted by the lamp in a peripheral symmetrical pattern which extends around axis 36. It is a feature of such lamps that a disproportionately large percentage of the total luminous flux is emitted in an annulus 42 which lies between two end regions 43, 44 which bound it at the ends. By "disproportionately large percentage" is meant a percentage of the total luminous flux which is substantially greater than the angular subtense (included angle 42) bears to 180°. In one common lamp, about 75% of the luminous flux is emitted in an annulus whose included angle is 100°, rather than the 55% (100/180) which would be emitted if the emission were uniform. Of course the actual values will differ from lamp type to lamp type, but this type of emission pattern is characteristic of this type of lamp, and it is well known to persons skilled in the art. Relatively little light is emitted from the end regions toward the socket end or forwardly toward the tip end of the lamp. The annulus referred to is, of course, a body of revolution generated around axis 36.

Curve 45 is a curve which shows the value of the luminous flux at all angles measured radially outward from point 39. The distance of the intersection of curve 45 with any ray from point 39 represents the intensity along that ray. This is why this distance is greater nearer the reference plane 41. Therefore, it is an advantage to control the distribution of a significant part of the luminous flux within that annulus, because that is where the major portion of the light originates, and improved results can be obtained with smaller reflective surfaces. It will be understood that the luminous flux extends entirely around axis 36, and it will further be noted that when the lamp is inside a reflector, as much of the light goes upwardly as goes downwardly. It will further be recognized that the single lower left-hand quadrant which is shown in detail in FIG. 5, is repeated in the other three quadrants symmetrically across plane 41, although there may be some minor differences between regions 43 and 44.

FIG. 6 shows a luminaire 30 producing a rectangular light pattern 22. Only one quadrant, bounded by lines AB and BC, is shown. The limiting rays are shown as exemplified by exemplary ray 50. This quadrant is repeated 3 times, this being the upper right-hand quadrant looking down atop luminaire 30. Of course, there are multitudinous rays terminating inside the quadrant to illuminate the area, and the terminal lines in a practical installation are somewhat curved, rather than straight, and the corners are rounded, rather than sharp, as shown in FIG. 3A.

FIG. 7 shows in elevation that which is shown in plan in FIG. 6. It illustrates reflection from a reflecting means 51, limited by a cutoff edge 52, to produce a group of rays within angular subtense 53 comprising downwardly directed rays (direct light) passing directly from the lamp through an aperture defined by cutoff edge 52, and reflected rays (supplementary light) in subtense 54 which are reflected from the lamp to illuminate areas which are not directly lighted, and to some extent supplement areas where the direct light is insufficient for the intended application.

Before proceeding further with the description of the reflector, it may be observed here that if the bare lamp luminous flux analysis is made as shown in FIG. 5, and the radiating lines from the center point are spaced apart such that if a respective area of wedge-shaped areas inside the candlepower curve are approximately equal in area, then rays between the bounding rays of these areas will impinge on a reflecting surface (viewed in plan) with energy in equal amounts of light for reflection. This provides a basis for the development of the shape of specular reflecting means in plan view. It will be understood, of course, that the cross-section in plan view will be different from elevation to elevation, but the ability to divide the reflecting surface into areas of equal luminous flux enables one to develop a correct reflecting surface for each elevation. The shaded areas in FIG. 5 are exemplary of the technique, although the illuminated areas are not necessarily equal in size. FIG. 5 does show that the designer can subdivide this graph as grossly or as finely as he wishes, so as to make as coarse or as near an approximation to ideal distribution as he wishes.

Figure 11:
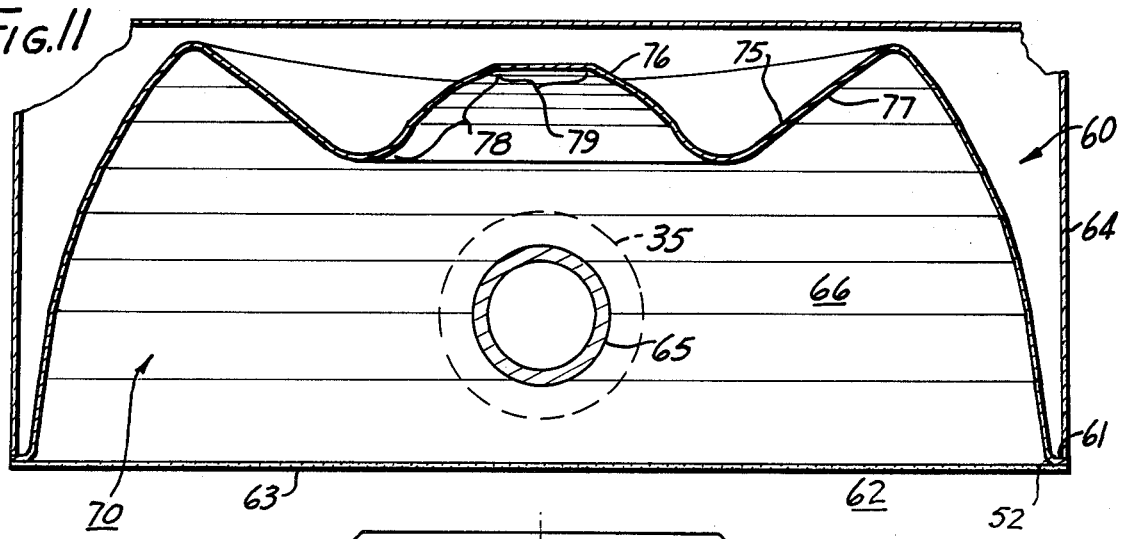
FIG. 11 is a side sectional view taken at line 11—11 of FIG. 10 and also showing a clear pane covering the aperture of the luminaire.
Figure 10:
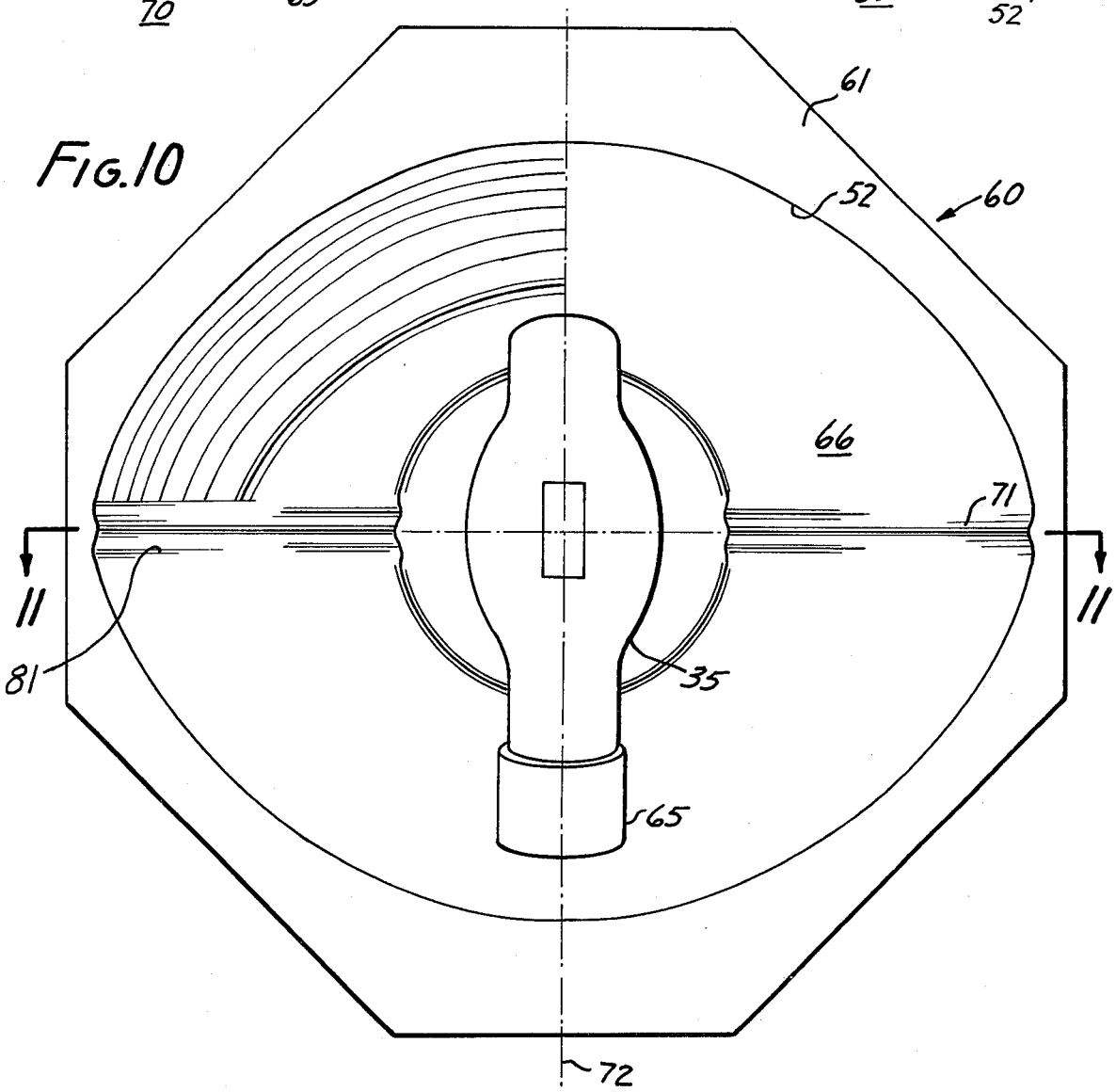
FIG. 10 is a bottom view of a reflector according to the invention.

A suitable reflector is shown in FIGS. 10 and 11. In FIG. 10 there is shown a reflector 60 having a peripheral mounting flange 61 which at its inner edge forms the cutoff edge 52 referred to above. Of course, the cutoff edge could be supplied by a separate plate, if preferred. The cutoff edge defines an aperture 62 which, as shown in FIG. 11, can be covered by a pane 63 of clear glass. The entire structure can be enclosed in a housing 64 which can also accommodate the other necessary elements of an area light, such as ballasts, capacitors and the like.

The reflector includes support means 65 to hold a lamp 35 in position inside cavity 66 within the reflector. As can best be seen in FIG. 11, the lamp is positioned entirely within the cavity and does not project beyond the aperture. The reflector includes reflecting means 70 which are shown in detail only in one quadrant, it being understood that this means will be repeated four times so as to be symmetrical across two vertical planes that are the intersections of planes normal to the plane of FIG. 10, and which intersect. Thus each quadrant of the ground surface receives supplementary light from a respective quadrant on the reflecting means. The fully illustrated quadrant reflects downwardly and across FIG. 10.

A spacer 75 supports a cap 76 in the middle of the reflecting means. This spacer is re-entrant in shape so as to bring the cap downwardly toward the lamp. Spacer surface 77 is diffuse, while the reflecting surface 78 of the cap is generally specularly reflective, except at a central portion 79 which may either be eliminated or be made diffuse as preferred.

The "lemon-shaped" cutoff edge shown in FIG. 10, together with the reflecting means and the lamp, together provide a substantially rectangular, in this case a more nearly square, illumination of a ground area.

FIG. 8 shows a means for developing the correct shape of reflecting means in one quadrant of the reflector. Solid line 80 represents a specularly-reflective surface facing into the cavity and toward the lamp. The size of the lamp and its location are not drawn to scale, because the lamp is treated as a point source and a more precise showing of the lamp would only confuse the drawings.

The preferred development in plan view is, having in mind the angular subtenses from point 39 which hold equal quantities of luminous flux as discussed above, to divide the reflecting surface into actual or theoretical increments that have an angular relationship such as to direct that portion of the beam to an area which requires supplemental light so the area will properly lighted.

Distributor surfaces 81 (FIG. 10) in the form of extended concave-convex ribs are formed where and adjacent to where the normal plane to axis 36 through point 39 intersects the reflecting means. This makes a broader distribution of light from this most intense region. The angular subtenses having equal intensity are so small here that they make precise control of this region with a single curved surface unduly difficult. A more diffuse distribution is tolerably within a few degrees of line 71.

It will be noted that toward line 71 relatively smaller portions of reflector surfaces are needed, because the luminous flux is greater in this region, while farther away from that line a larger portion of the reflector surface is needed to reflect the same quantum of light. It is evident that the reflecting surfaces as shown can be made in straight-line segments, or instead the points could be located, using any desired number, and then a smooth surface is used to joint them. Rays A,B,C,N and Q are exemplary rays that show the way these rays are reflected from the reflecting surface at similarly labeled points.

Figure 9:
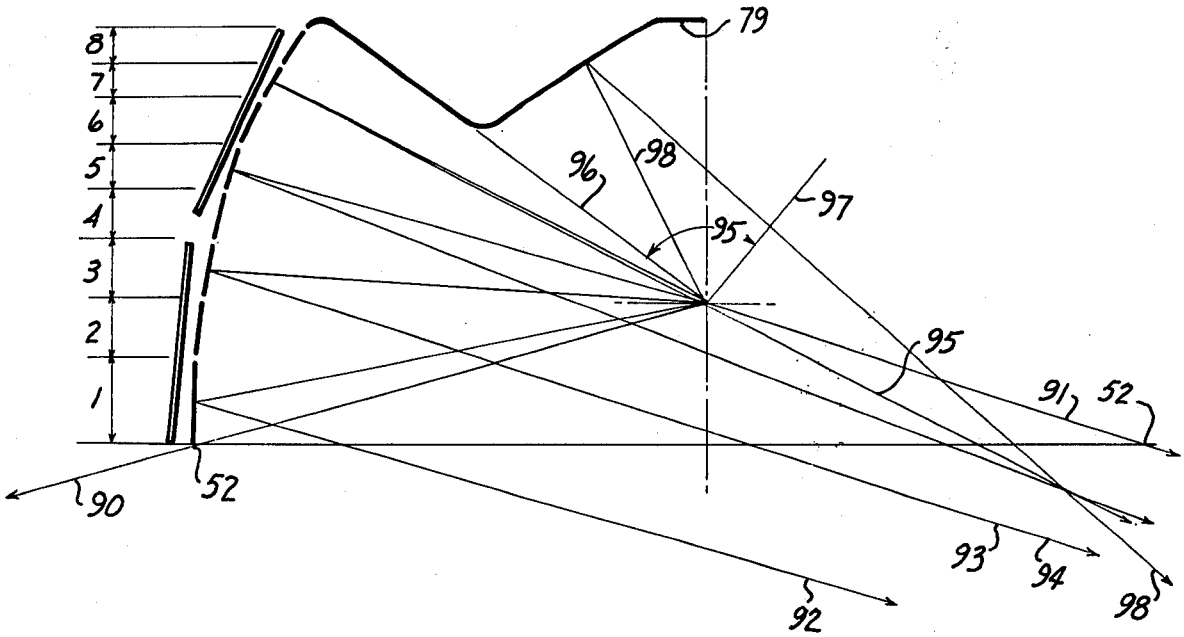
FIG. 9 is a vertical section showing certain design criteria for the reflecting means.

The disposition of rays in plan view is obviously only half of the solution, because it is also necessary to direct these up and down as well as from side to side. The plan arrangement attends to "azimuth", and the elevation arrangement attends to "elevation" of the rays. The development of elevation is shown in FIG. 9. The luminar intensity is uniform all the way around axis 36. Equal angular division will provide equal quantities of flux with respective "bundles", and the amount of flux in each "bundle" of rays sent to each area on the ground is therefore readily arranged with the angular considerations shown in FIGS. 8 and 9. Sufficient to say that the designer need only divide the output into bundles with regard to plan and elevation, and then determine the orientation of the reflector surface where the bundle strikes it so as to reflect the bundle where it is needed. This is simply a geometrical task which calls for patient endeavor.

With regard to FIG. 9, flux between the limiting rays 90, 91 is emitted directly to the ground surface by the lamp. Of course, the intensity on the ground differs in the plane normal to FIG. 9, because of the asymmetrical distribution as described in FIG. 5.

It is preferable for the beams as reflected by the reflecting means diverge on the order of 2 to 6 degrees included conical angle. The reflecting means may be made into individual band-like facets as shown, or a suitable number of points may be calculated and drawn and then connected to make a smooth continuous curve. However this is done, bundles of rays of appropriate luminous flux are reflected by the reflecting means in various directions, some exemplary rays being shown by rays 92, 93, 94, which are so situated as to fill in with light some of the areas where the direct illumination is insufficient. FIG. 7 aptly illustrates this feature. The designer will keep in mind the inverse square relationship of the bundles of rays, and the angle of incidence with the ground. Of course, the bundle concept is approximate. The reflecting means does not, in its best embodiment, send out discrete beams, but rather a full surface illumination with a desired pattern without abrupt changes of illumination within the boundary of the illuminated area.

The spacer means, as is best shown in FIG. 9, makes no direct reflection and is provided merely as a reentrant support to hold the cap close to the lamp, and thereby keep the overall height of the reflector to a minimum. Light to a subtense 95, limited by rays 96, 97, goes upwardly to the cap. These upward rays strike an annular portion of the cap which is reflective and circularly concave and is disposed so as to reflect rays, of which 98 is typical, downwardly and away from the lamp, principally through the aperture. The central portion 79 of the cap is diffuse so as to minimize the direct return of light to the lamp. Direct reflection of light to the lamp is deleterious to its efficiency. It will now be seen from FIGS. 8 and 9 that the reflecting means, and to some extent also the cap, reflect supplementary light to the ground on paths which avoid the lamp to the maximum extent possible.

The presently preferred construction of the reflector is a single structural part which can be formed by hydroforming, stamping, electromagnetic forming, explosion forming, or stretch forming. A practical reflector will not ordinarily be an exactly theoretically optimum reflector, because the theoretical shape may not be compatible with practical methods of manufacture. Also, the reflecting means usually will have some slight wrinkles or imperfections which could direct light to incorrect areas. Such imperfections can also occur during polishing and plating processes, causing the same undesirable results. Accordingly, some slight faceting of the sidewall by peening or otherwise will smooth out bothersome flaws in the light pattern as seen on the illuminated surface, without departing from the invention.

Another means is best shown in FIG. 8 wherein a faceting action is provided by forming the reflecting means as a group of facets rather than as a smooth curve. The bent lines show this feature. The continuous line shows the other way. The facets tend to smooth out the light by creating a fanning action wherein each beam overlaps its neighbor. The length of each facet can be the same as the others, or different and depending on the geometry of the reflector system. Generally, the facets will be shorter horizontally in the upper elevations than in the lower elevation, because the reflector narrows toward the top. The surfaces can also be a mixture of smooth curves and planar facets.

A one-piece structure is a relatively expensive device to tool up for. One could instead manufacture a near approximation to the ideal device by means shown in FIG. 12 wherein a support 110 holds bands 111, 112 shaped according to the considerations given above. There can be any desired number of bands. They can be formed one at a time and placed in supports where they are held to form reflecting means. They could either be continuously curved or might, for example, include flat faceted regions such as regions 113 in FIG. 12. A cap section 114 can be formed in the pleated shape shown only in end view.

Figure 14:
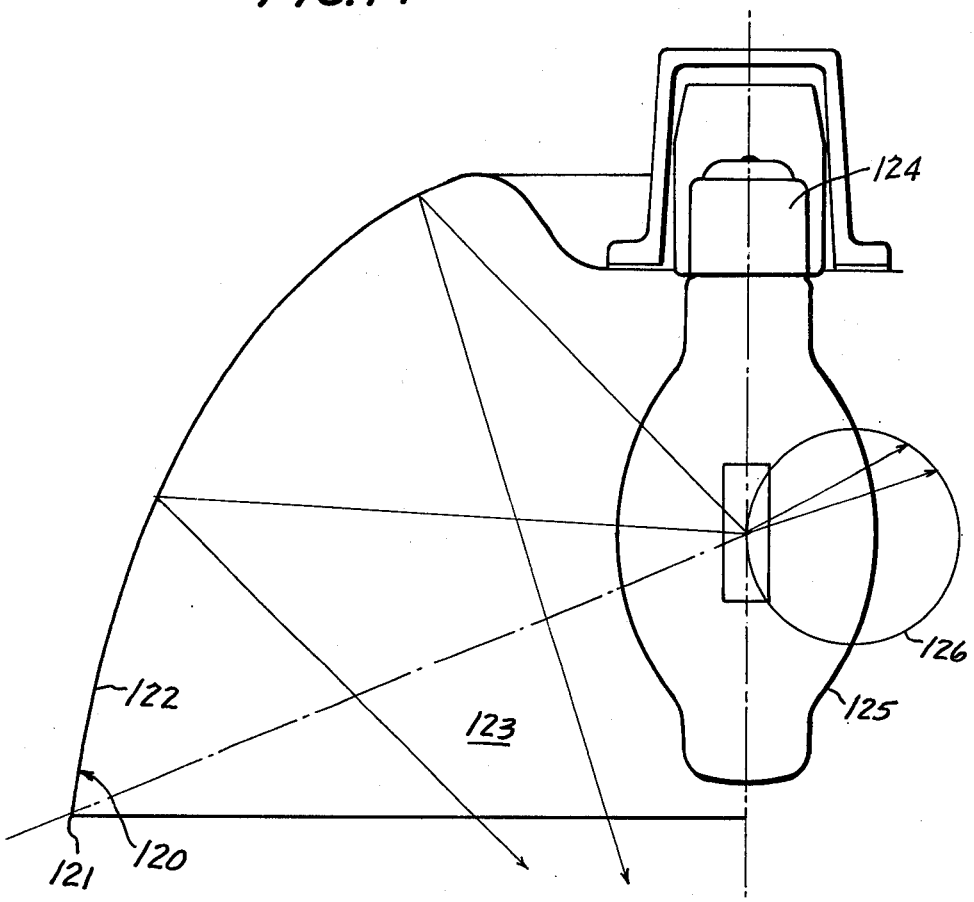
FIG. 14 shows an adaptation of the invention for indoor use.

FIG. 14 shows the device adapted for interior use. In exterior use, for wide-area illumination, a sharp cutoff at the edge is not as greatly appreciated as it is in an interior use. Inside a building, a sharp cutoff edge is considerable advantage. Similarly, in interiors, a relatively smaller ratio between the horizontal throw and the mounting height may be desired. In such a circumstance, the axis of the lamp may advantageously be disposed vertically in the reflector instead of horizontally. A vertical orientation is illustrated in FIG. 14.

In FIG. 14 a reflector 120 is shown with a cutoff edge 121, reflecting means 122, cavity 123, and support means 124 for a lamp 125 of the type heretofore described. The luminar distribution of the lamp is identical to that shown in FIG. 5, and is shown by curve 126. The difference between the device of FIGS. 10 and 14 is that the region at the end of the lamp which provides the lesser luminar intensity emits most of its light directly through the aperture, and the preponderant proportion of the flux is controlled by the reflecting means. The analysis and development of the reflecting means is precisely as already described, except that the reflecting means provides the predominant portion of the illumination at the center as well as at the sides. Only one quadrant is shown. The reflector is symmetrical as in FIG. 10.

The foregoing device meets the general objectives of the invention, which is to provide a luminaire that produces a substantially rectangular light pattern from a single fixture, and which can utilize a single high intensity discharge lamp of the type commonly referred to as mercury vapor, metallic halide, or high pressure sodium. It is intended to produce a light pattern with good cutoff at about 75° from the vertical, and with no light emitted at all at or above 90°. In the preferred embodiment, the reflector is provided in one piece which provides for ease of production and handling and allows for sealing the cavity so as to prevent light loss from dirty surfaces within the optical chamber.

The reflector can be enclosed in a simple housing with clean lines and with an absence of visible exposed fasteners or welds and without utilizing a prismatic lens. The lamp and the reflector comprise the entire optical system of the luminaire. For a device suitable to illuminate a square area of approximately 150 feet on the side from an elevation approximately 30 feet above the ground, the following are a few illustrative dimensions.

Cutoff Aperture: 18 inches long, 15 inches wide

Top of reflecting means: 12 inches long, 10 inches wide

Diameter of cap: 6 inches

The above dimensions are approximate and in inches.

To lay out the device completely requires literally hundreds of individual dimensions, which it would serve no useful purpose to set forth in detail here. However, persons skilled in the art can readily calculate, with the aid of the inverse square law, and from a knowledge of the lamp parameters, the angles and areas on the reflecting means required to produce the illumination desired at each specific area, using the above gross dimensions as a guideline. Also, bearing the above considerations in mind, one can manually develop the shape by bending a reflective surface until the distribution of the light meets his objectives.

This invention is not to be limited by the embodiments shown in the drawings and described in the description, which are given by way of example and not of limitation, but only in accordance with the scope of the appended claims.

We claim:

1. A reflector having a nominal axis of emission for casting a pattern of light which is substantially rectangular in a plane normal to said axis of emission from a lamp which has an axis of radiation and the property of emitting a disproportionately larger percentage of its luminous flux in an annulus which lies between a substantial bounding region at each end of the lamp boundary, in which said boundary regions the emission is disproportionately low, said reflector having a concave cavity, a cutoff edge forming an aperture opening from said cavity, said aperture being devoid of any refracting element and of any reflecting element, said cutoff edge lying in a plane normal to said nominal axis, support means to mount the lamp in the cavity above the cutoff edge, and specularly reflecting means shaped and placed in the cavity whereby to reflect supplementary light rays comprising at least some of the light rays emitted from the lamp in the angular subtense above the limiting rays which graze the cutoff edge into a pattern supplementary to direct rays which pass directly from the lamp through the aperture to the surface in ares on the surface where the direct rays provide insufficient illumination to form a substantially rectangular pattern with a predetermined luminar intensity on areas of said surface which is a function of the distance of the respective areas from the intersection of nominal axis with the surface, said supplementary light rays, together with the direct rays, providing such illumination over substantially the entire pattern.

2. A reflector according to claim 1 in which the support means is disposed and arranged so as to hold the lamp with its axis normal to the nominal axis.

3. A reflector according to claim 1 in which the support means is disposed and arranged so as to hold the lamp with its axis prallel to the nominal axis.

4. A reflector according to claim 1 in which said reflecting means is disposed so that rays reflected by it miss the emitter of the lamp.

5. A reflector according to claim 1 in which a reflective cap is disposed centrally in the reflecting means to reflect rays through the aperture.

6. A reflector according to claim 5 in which the surface of the cap is specularly reflective.

7. A reflector according to claim 5 in which the cap comprises a concave reflector of smaller lateral dimensions than the portion of the reflecting means nearest to it, said cap being joined to the reflector by a re-entrant peripheral spacer.

8. A reflector according to claim 7 in which said spacer is disposed and arranged so as not to intercept any substantial quantity of rays directly from the lamp.

9. A reflector according to claim 8 in which the spacer is diffusely surfaced.

10. A reflector according to claim 1 in which the reflecting means is symmetrical across two planes which include said nominal axis and are normal to each other, their intersection including said nominal axis.

11. A reflector according to claim 1 in which a reflecting distributor surface is included in the reflecting means, which extends generally parallel to the nominal axis and is intersected by a plane normal to the axis of the lamp, whereby to distribute light from the most intense region of the lamp independently of the remainder of the reflector.

12. A reflector according to claim 11 in which the distributor surface has a substantial dimension of width.

13. A reflector according to claim 1 in which the reflecting means is a unitary structure.

14. A reflector according to claim 13 in which the reflecting means is generally smoothly curved.

15. A reflector according to claim 13 in which the reflecting means includes facets which lie adjacent to one another and extend, band-like, parallel to the aperture.

16. A reflector according to claim 15 in which the reflecting means comprises a plurality of separate strips.

17. In combination: a lamp which has an axis of radiation and the property of emitting a disproportionately larger percentage of its luminous flux in an annulus which lies between a substantial bounding region at each end of the lamp, in which said bounding regions the emission is disproportionately low; and a reflector having a nominal axis of emission for casting from said lamp a pattern of light which is substantially rectangular in a plane normal to said axis of emission, said reflector having a concave cavity, a cutoff edge forming an aperture opening from said cavity, said aperture being devoid of any refracting element and of any reflecting element, said cutoff edge lying in a plane normal to said nominal axis, support means mounting the lamp in the cavity above the cutoff edge, and specularly reflecting means shaped and placed in the cavity whereby to reflect supplementary light rays comprising at least some of the light rays emitted from the lamp in the angular subtense above the limiting rays which graze the cutoff edge into a pattern supplementary to direct rays which pass directly from the lamp through the aperture to the surface in areas on the surface where the direct rays provide insufficient illumination to form a substantially rectangular pattern with a predetermined luminar intensity on areas of said surface which is a function of the distance of the respective areas from the intersection of the nominal axis with the surface, said supplementary light rays, together with the direct rays, providing such illumination over substantially the entire pattern.

18. A combination according to claim 17 in which the support means is disposed and arranged so as to hold the lamp with its axis normal to the nominal axis.

19. A reflector according to claim 17 in which the support means is disposed and arranged so as to hold the lamp with its axis parallel to the nominal axis.

20. A combination according to claim 17 in which said reflecting means is disposed so that rays reflected by it miss the emitter of the lamp.

21. A combination according to claim 17 in which a reflective cap is disposed centrally in the reflecting means to reflect rays through the aperture.

22. A combination according to claim 21 in which the surface of the cap is specularly reflective.

23. A combination according to claim 21 in which the cap comprises a concave reflector of smaller lateral dimensions than the portion of the reflecting means nearest to it, said cap being joined to the reflector by a re-entrant peripheral spacer.

24. A combination according to claim 23 in which said spacer is disposed and arranged so as not to intercept any substantial quantity of rays directly from the lamp.

25. A combination according to claim 24 in which the spacer is diffusely surfaced.

26. A combination according to claim 17 in which the reflecting means is symmetrical across two planes which include said nominal axis and are normal to each other, their intersection including said nominal axis.

27. A combination according to claim 17 in which a reflecting distributor surface is included in the reflecting means, which extends generally parallel to the nominal axis and is intersected by a plane normal to the axis of the lamp, whereby to distribute light from the most intense region of the lamp independently of the remainder of the reflector.

28. A combination according to claim 27 in which the distributor surface has a substantial dimension of width.

29. A combination according to claim 17 in which the reflecting means is a unitary structure.

30. A combination according to claim 29 in which the reflecting means is generally smoothly curved.

31. A combination according to claim 29 in which the reflecting means includes facets which lie adjacent to one another and extend, band-like, parallel to the aperture.

32. A combination according to claim 31 in which the reflecting means comprises a plurality of separate strips.

* * * * *